US009915061B1

(12) United States Patent
DeFalco

(10) Patent No.: US 9,915,061 B1
(45) Date of Patent: Mar. 13, 2018

(54) TOILET FLANGE ADAPTER TILE

(71) Applicant: Guy DeFalco, Mays Landing, NJ (US)

(72) Inventor: Guy DeFalco, Mays Landing, NJ (US)

( * ) Notice: Subject to any disclaimer, the term of this patent is extended or adjusted under 35 U.S.C. 154(b) by 1 day.

(21) Appl. No.: 15/175,131

(22) Filed: Jun. 7, 2016

(51) Int. Cl.
*E03D 11/16* (2006.01)
*E04F 21/00* (2006.01)

(52) U.S. Cl.
CPC ..... *E03D 11/16* (2013.01); *E04F 21/0076* (2013.01)

(58) Field of Classification Search
CPC ..... E04F 21/0076; E03D 11/16
See application file for complete search history.

(56) References Cited

U.S. PATENT DOCUMENTS 4,780,915 A 11/1988 Cuschera
D647,181 S 10/2011 Kovach
8,898,823 B2 12/2014 McHugh, III
9,074,377 B2 7/2015 Wood
9,091,076 B2 7/2015 Amer
2004/0060183 A1* 4/2004 Moas ..... B25H 7/02 33/526
2014/0230361 A1 8/2014 Wood

FOREIGN PATENT DOCUMENTS

WO 9218282 A1 10/1992

* cited by examiner

*Primary Examiner* — Janie Loeppke

(57) ABSTRACT

The toilet flange adapter tile is adapted for use with flooring tiles. The toilet flange adapter tile is further adapted for use with toilets. The toilet flange adapter tile is a preformed tile that comprises an aperture that is sized to fit around the floor flange and fixture gasket of a standard plumbing hook up for a toilet. The toilet flange adapter tile further comprises a plurality of scoring lines that allow the toilet flange adapter tile to be readily cut to fit into the master tile pattern the toilet flange adapter tile is being integrated. The toilet flange adapter tile further comprises a plurality of mounting holes that allow the toilet flange adapter tile to be secured to the under flooring during installation. The toilet flange adapter tile is a tile that further comprises an aperture, a plurality of mounting holes; and a plurality of scoring lines.

2 Claims, 3 Drawing Sheets

TOILET FLANGE ADAPTER TILE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of finishing work on buildings and floors of buildings, more specifically, a floor covering made of a paving or tile type material.

SUMMARY OF INVENTION

The toilet flange adapter tile is adapted for use with flooring tiles. The toilet flange adapter tile is further adapted for use with toilets. The toilet flange adapter tile is a preformed tile that comprises an aperture that is sized to fit around the floor flange and fixture gasket of a standard plumbing hook up for a toilet. The toilet flange adapter tile further comprises a plurality of scoring lines that allow the toilet flange adapter tile to be readily cut to fit into the master tile pattern the toilet flange adapter tile is being integrated. The toilet flange adapter tile further comprises a plurality of mounting holes that allow the toilet flange adapter tile to be secured to the under flooring during installation.

These together with additional objects, features and advantages of the toilet flange adapter tile will be readily apparent to those of ordinary skill in the art upon reading the following detailed description of the presently preferred, but nonetheless illustrative, embodiments when taken in conjunction with the accompanying drawings.

In this respect, before explaining the current embodiments of the toilet flange adapter tile in detail, it is to be understood that the toilet flange adapter tile is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toilet flange adapter tile.

It is therefore important that the claims be regarded as including such equivalent construction insofar as they do not depart from the spirit and scope of the toilet flange adapter tile. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
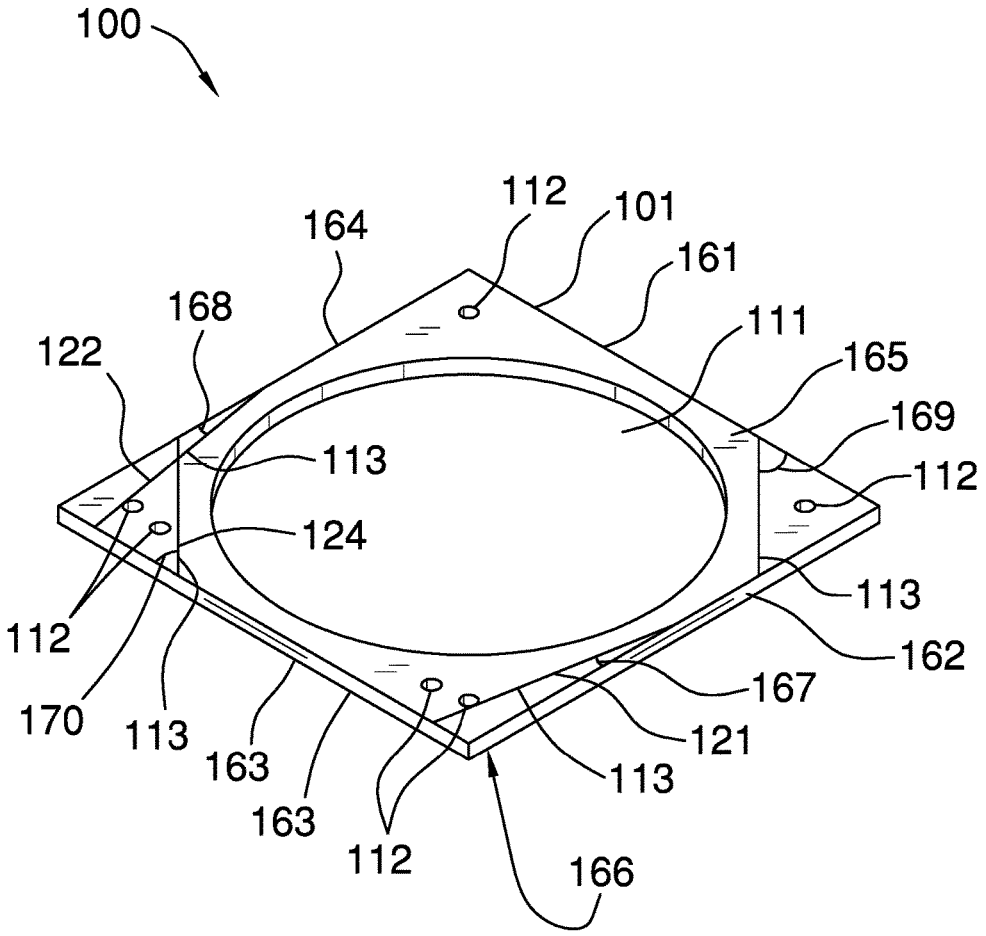
FIG. 1 is a perspective view of an embodiment of the disclosure.
Figure 2:
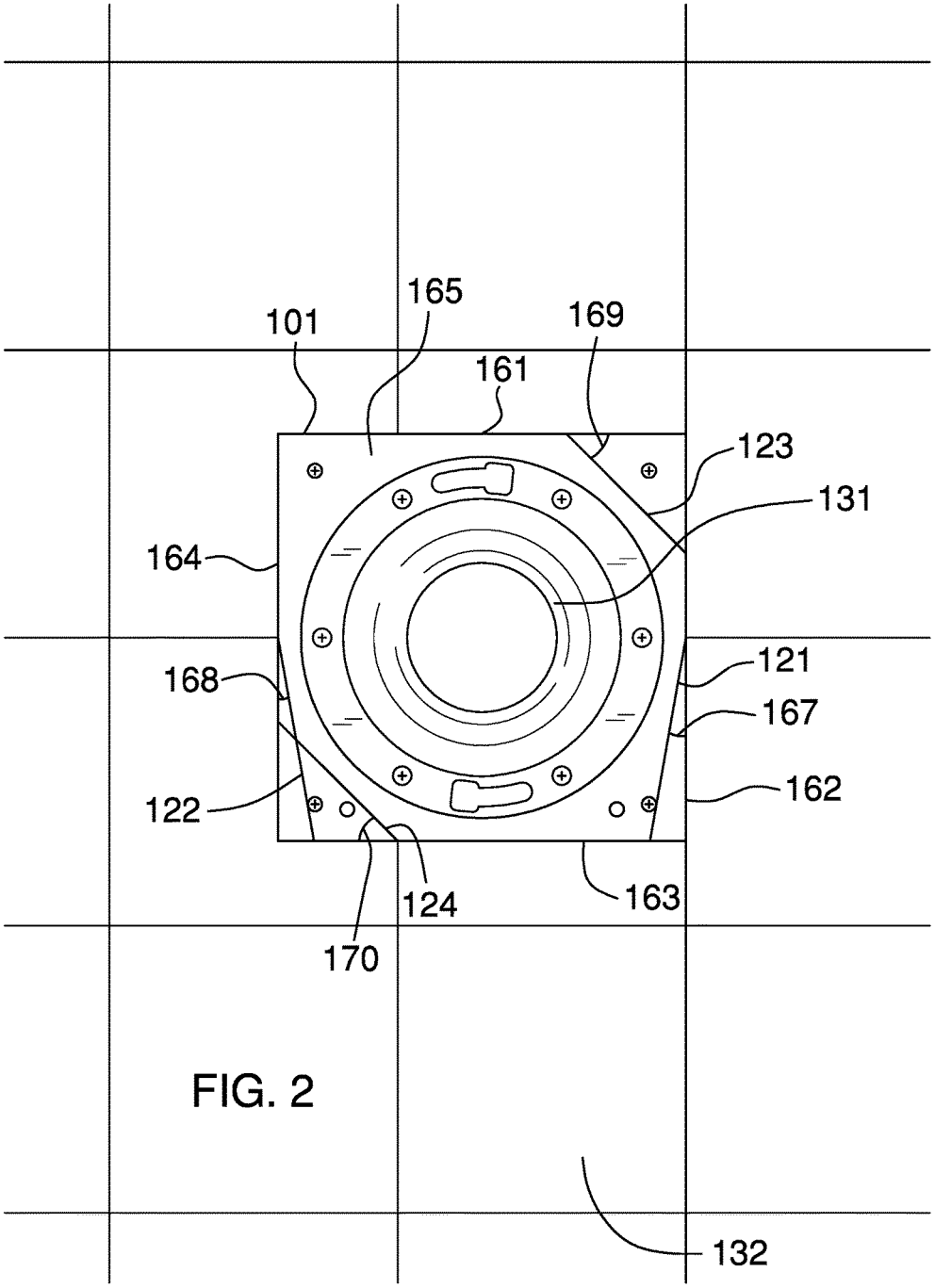
FIG. 2 is a top in use view of an embodiment of the disclosure.
Figure 3:
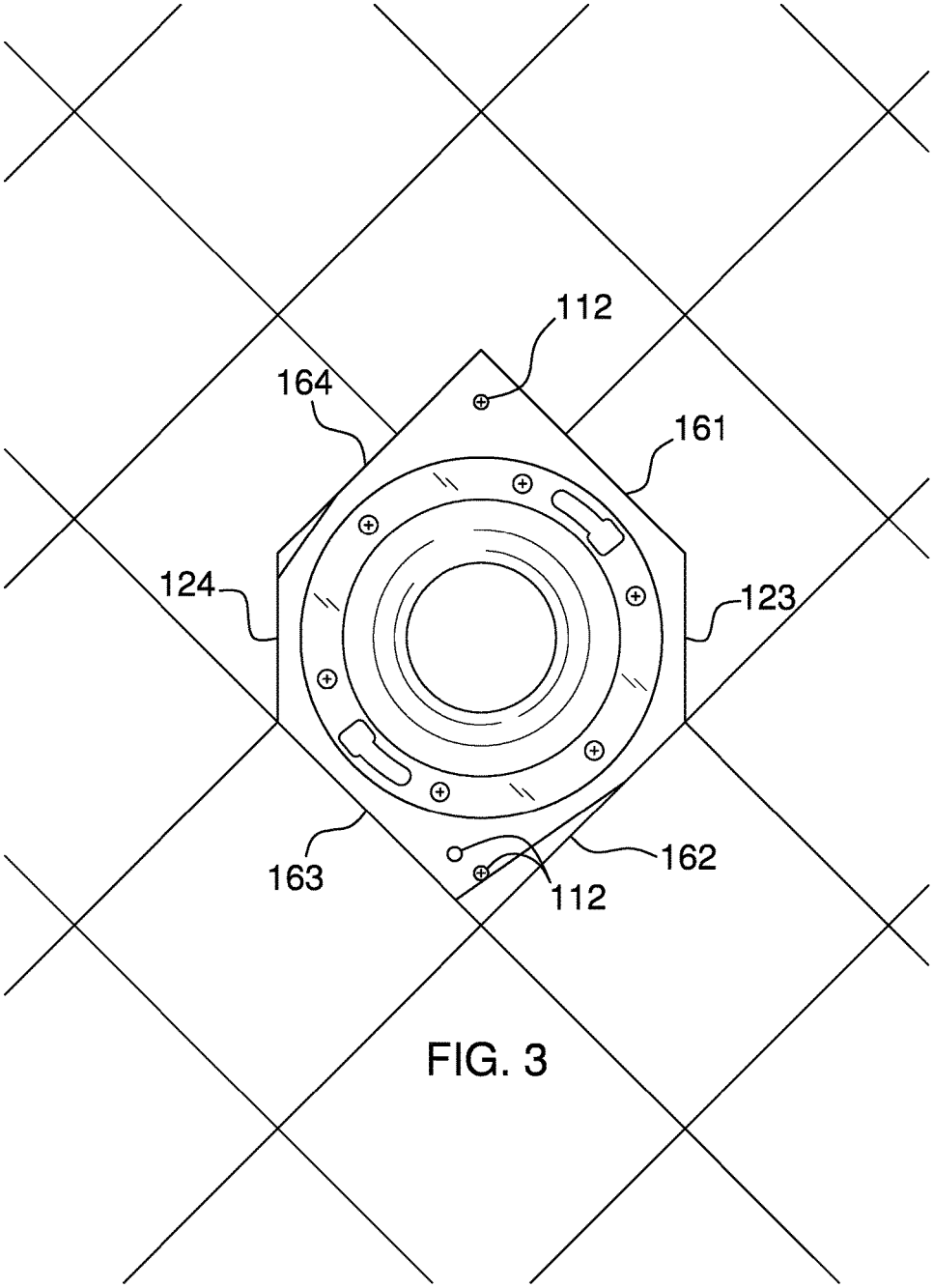
FIG. 3 is a top in use view of an alternate implementation of an embodiment of the disclosure.

Detailed reference will now be made to a first potential embodiment of the disclosure, which is illustrated in FIGS. 1 through 3.

The toilet flange adapter tile 100 (hereinafter invention) is a tile 101 that further comprises an aperture 111, a plurality of mounting holes 112, and a plurality of scoring lines 113. The invention 100 is adapted for use with flooring tiles 132. The invention 100 is further adapted for use with domestic plumbing. The invention 100 is a preformed tile 101 that comprises an aperture 111 that is sized to fit around the floor flange and fixture gasket 131 of a standard plumbing hook up for a toilet. The invention 100 further comprises a plurality of scoring lines 113 that allow the invention 100 to be readily cut to allow the invention 100 to be integrated into the master tiling pattern. The invention 100 further comprises a plurality of mounting holes 112 that allow the invention 100 to be secured to the under flooring during installation.

As shown most clearly in FIG. 1, the tile 101 is a plate. In the first potential embodiment of the disclosure, the tile 101 is a rectangular plate that is further defined with a first edge 161, a second edge 162, a third edge 163, a fourth edge 164, a first surface 165 and a second surface 166. The tile 101 is formed with an aperture 111. The aperture 111 is an opening through the tile 101 that is formed in the tile 101 from the first surface 165 through to the second surface 166. In the first potential embodiment of the disclosure, the aperture 111 is circular in shape with a diameter span that is large enough that the floor flange and fixture gasket 131 will fit through the aperture 111.

As shown most clearly in FIGS. 2 and 3, each of the plurality of mounting holes 112 is an opening that is formed in the tile 101 from the first surface 165 through to the second surface 166. Each of the plurality of mounting holes 112 is a circular opening that is sized to receive a screw or a flooring nail such that the screw or flooring nail will secure the tile 101 to the under flooring.

As shown most clearly in FIG. 1, each of the plurality of scoring lines 113 is a scoring line that is prepositioned within the tile 101. Each of the plurality of scoring lines 113 is a weakness in the tile 101 that allows the tile 101 to be readily cut using a manual tile cutter or a wet saw. Each of the plurality of scoring lines 113 are selected such that the tile 101 can be readily integrated into commonly used tiling patterns.

In the first potential embodiment of the disclosure, the plurality of scoring lines 113 further comprises a first scoring line 121, a second scoring line 122, a third scoring line 123, and a fourth scoring line 124. The first scoring line 121 runs from the second edge 162 to the third edge 163 and forms a first angle 167 between the first scoring line 121 and the second edge 162. The second scoring line 122 runs from the fourth edge 164 to the third edge 163 and forms a second angle 168 between the second scoring line 122 and the fourth edge 164. The third scoring line 123 runs from the first edge 161 to the second edge 162 and forms a third angle 169 between the third scoring line 123 and the first edge 161. The fourth scoring line 124 runs from the fourth edge 164 to the third edge 163 and forms a fourth angle 170 between the fourth scoring line 124 and the third edge 163. In the first potential embodiment of the disclosure, the first angle 167 is 10 degrees, the second angle 168 is 10 degrees, the third angle 169 is 45 degrees and the fourth angle 170 is 45 degrees.

To use the invention 100, the invention 100 is cut at the scoring lines selected from the plurality of scoring lines 113 when necessary. The invention 100 is then placed over the floor flange and fixture gasket 131 and flooring tiles 132 are installed around the invention 100 such that the invention 100 is integrated into the flooring pattern. As shown in FIG. 2, the invention 100 is integrated into the flooring panels without requiring cuts at any of the plurality of scoring lines 113. As shown in FIG. 3, the invention 100 is integrated into the flooring pattern by cutting the third scoring line 123 and the fourth scoring line 124.

In the first potential embodiment of the invention 100, the tile 101 is a ceramic tile that is initially formed in a plaster mold and then fired. The diameter of the aperture 111 is 7.125 inches.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Diameter: As used in this disclosure, a diameter of an object is a straight line segment that passes through the center of an object. The line segment of the diameter is terminated at the boundary of the object through which the line segment of the diameter runs.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Tile: As used in this disclosure, a tile is a thin flat slab of material that is selected from a plurality of tiles and is used for covering a surface such as a floor or a wall. Generally, when covering the surface each tile selected from the plurality of tiles is laid out as part of a regular or repeating pattern.

With respect to the above description, it is to be realized that the optimum dimensional relationship for the various components of the invention described above and in FIGS. 1 through 3, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A flooring tile comprising:

a tile;

wherein the tile further comprises an aperture;

wherein the flooring tile is adapted for use with other flooring tiles;

wherein the flooring tile is further adapted for use with domestic plumbing;

wherein the floor tile is adapted for use with a combination of a floor flange and a fixture gasket;

wherein the floor tile fits around the combination of the floor flange and the fixture gasket;

wherein the tile is a rectangular plate;

wherein the tile is further defined with a first edge, a second edge, a third edge, a fourth edge, a first surface and a second surface;

wherein the aperture is an opening through the tile that is formed in the tile from the first surface through to the second surface;

wherein the aperture is circular in shape;

wherein the span of the diameter of the aperture that is large enough that the combination of the floor flange and the fixture gasket will fit through the aperture;

wherein the flooring tile further comprises a plurality of mounting holes;

wherein each of the plurality of mounting holes is an opening that is formed in the tile from the first surface through to the second surface;

wherein each of the plurality of mounting holes is circular;

wherein each of the plurality of mounting holes is sized to receive a screw or a flooring nail;

wherein each of a plurality of scoring lines is a scoring line that is prepositioned within the tile;

wherein the plurality of scoring lines comprises a first scoring line and a second scoring line;

wherein the first scoring line runs from the second edge to the third edge;

wherein the second scoring line runs from the fourth edge to the third edge;

wherein the first scoring line forms a first angle between the first scoring line and the second edge;

wherein the second scoring line forms a second angle between the second scoring line and the fourth edge;

wherein the first angle is between 5 and 30 degrees;

wherein the second angle is between 5 and 30 degrees;

wherein the plurality of scoring lines comprises a third scoring line and a fourth scoring line;

wherein the third scoring line runs from the first edge to the second edge;

wherein the fourth scoring line runs from the fourth edge to the third edge;

wherein the third scoring line forms a third angle between the third scoring line and the first edge;

wherein the fourth scoring line forms a fourth angle between the fourth scoring line and the third edge;

wherein the third angle is between 30 and 60 degrees;

wherein the fourth angle is between 30 and 60 degrees;

wherein the tile is formed from ceramic.

2. The flooring tile according to claim 1 wherein the span of the diameter of the aperture is greater than or equal to seven inches.

* * * * *